US010328716B2

(12) United States Patent
Xavier et al.

(10) Patent No.: US 10,328,716 B2
(45) Date of Patent: Jun. 25, 2019

(54) METHOD FOR MANAGING A THERMAL PRINTER, CORRESPONDING DEVICE AND PROGRAM

(71) Applicant: INGENICO GROUP, Paris (FR)

(72) Inventors: Bruno Xavier, Valence (FR); Arnaud Zanetti, Guilherand-Granges (FR)

(73) Assignee: INGENICO GROUP, Paris (FR)

( * ) Notice: Subject to any disclaimer, the term of this patent is extended or adjusted under 35 U.S.C. 154(b) by 0 days.

(21) Appl. No.: 15/740,592

(22) PCT Filed: Jun. 30, 2016

(86) PCT No.: PCT/EP2016/065445

§ 371 (c)(1),
(2) Date: Dec. 28, 2017

(87) PCT Pub. No.: WO2017/001639

PCT Pub. Date: Jan. 5, 2017

(65) Prior Publication Data

US 2018/0319176 A1 Nov. 8, 2018

(30) Foreign Application Priority Data

Jun. 30, 2015 (FR) ..... 15 56132

(51) Int. Cl.
*B41J 2/35* (2006.01)
*B41J 2/355* (2006.01)
(Continued)

(52) U.S. Cl.
CPC ..... *B41J 2/3553* (2013.01); *B41J 2/35* (2013.01); *B41J 2/3558* (2013.01); *B41J 29/393* (2013.01);
(Continued)

(58) Field of Classification Search
CPC . B41J 2/3553; B41J 2/35; B41J 29/393; B41J 2/3558; B41J 2029/3932; G07F 17/42
See application file for complete search history.

(56) References Cited

U.S. PATENT DOCUMENTS 5,053,790 A * 10/1991 Stephenson ..... B41J 2/36 347/192
6,186,683 B1 * 2/2001 Shibuki ..... B41J 2/355 347/185
2016/0297208 A1 * 10/2016 Uryu ..... B41J 2/355

FOREIGN PATENT DOCUMENTS

DE 4003595 A1 8/1991
DE 4031193 A1 4/1992
(Continued)

OTHER PUBLICATIONS

International Search Report dated Sep. 9, 2016 for corresponding International Application No. PCT/EP2016/065445, filed Jun. 30, 2016.
(Continued)

*Primary Examiner* — Yaovi M Ameh
(74) *Attorney, Agent, or Firm* — David D. Brush; Westman, Champlin & Koehler, P.A.

(57) ABSTRACT

A method for managing printing of data by a thermal printer. The thermal printer includes a thermal print head. The thermal print head has a plurality of points, each point having an effective resistance $r_d$, and is powered by a power source. The method includes the following actions: measuring a voltage U given by the power source of the thermal printer; measuring an internal resistance $r_u$ of the power source; and computing a duration t for heating a number n of points as a function of the voltage U of the power source, the internal resistance $r_u$ of the power source, at least one effective resistance $r_d$ of at least one point corresponding to a dot to be printed for the printing of the data and as a
(Continued)

function of at least one value of parasitic resistance $r_p$ of at least one element of the thermal printer.

9 Claims, 4 Drawing Sheets

(51) Int. Cl.
*G07F 17/42* (2006.01)
*B41J 29/393* (2006.01)

(52) U.S. Cl.
CPC ..... *G07F 17/42* (2013.01); *B41J 2029/3932* (2013.01)

(56) References Cited

FOREIGN PATENT DOCUMENTS

| | | | |
|---|---|---|---|
| EP | 0648608 | A1 | 4/1995 |
| EP | 1655138 | A2 | 5/2006 |
| EP | 1658982 | A2 | 5/2006 |

OTHER PUBLICATIONS

Written Opinion of the International Searching Authority dated Sep. 9, 2016 for corresponding International Application No. PCT/EP2016/065445, filed Jun. 30, 2016.
English Translation of the International Preliminary Report on Patentability dated Jan. 30, 2017 for International Application No. PCT/EP2016/065445, filed Jun. 30, 2016.

* cited by examiner

METHOD FOR MANAGING A THERMAL PRINTER, CORRESPONDING DEVICE AND PROGRAM

CROSS-REFERENCE TO RELATED APPLICATIONS

This Application is a Section 371 National Stage Application of International Application No. PCT/EP2016/065445, filed Jun. 30, 2016, which is incorporated by reference in its entirety and published as WO 2017/001639 A1 on Jan. 5, 2017, not in English.

1. FIELD OF THE INVENTION

The proposed technique relates to the field of thermal printers. The proposed technique relates more particularly to techniques for managing thermal printers. The proposed technique can be applied especially in movable devices provided with a thermal printer, for example in payment terminals.

2. PRIOR ART

Thermal printers are widely used for various applications. They are especially used to print out cash receipts or payments vouchers from cash machines or payment terminals. The use of such printers generally raises no problem when the cash register or terminal is connected to a constant electrical power supply source (to the electrical mains for example). However, in a situation of mobility, the use of such a prior-art thermal printer raises problems.

Indeed, a thermal printer comprises a thermal print head constituted by a series of heating points, combined in units called printing modules. Each heating point normally has a predetermined resistance value (plus or minus a few variations). A module comprises for example 64 printing points and a print head comprises six modules, giving a total of 384 printing points. It has been observed however that the predetermined values of resistance can appreciably vary from one point to another depending on the constraints and conditions of manufacture.

The thermal head is supplied with constant voltage given by a switched power supply. The voltage needed to make a thermal printer work is of the order of 8 volts. At present, in a situation of mobility, such voltage is given by using two batteries. Indeed, to maintain performance in terms of printed lines per second, it should be possible to provide the energy needed for the thermal paper to change to black in the shortest possible time. Indeed, once the payment is made, it is indispensable for the payment voucher or the cash receipt to be issued in a short time, even in a situation of mobility.

Now this energy (W) is the product of the time (t) multiplied by the heating power of each point. If a set of points to be heated has a resistance with a value R, the energy needed (W) can be represented by the following formula:

$$W = P \times t = \frac{U^2}{R} \times t \tag{1}$$

In this formula, U represents the voltage exerted on the circuit of the thermal print head. In prior-art thermal printers, the time needed to heat the print head can be computed according to the following formula:

$$t = \frac{W \times R}{U^2} \tag{2}$$

Indeed, the energy W needed to heat a module of the thermal head (the set of points) and to attain a predetermined temperature can be obtained according to the specific heat capacity of the material of the print head. The voltage U is approximately equal to that of the power source, and the resistance R of the set of points is also known. To obtain printing within the prescribed time, it is therefore necessary to have available a voltage of 8 volts.

There are printers for terminals known in the prior art. Two solutions are used to provide voltage of the order of 8 volts with batteries. The first solution, illustrated with reference to FIG. 1*a*, consists of the series-mounting of two batteries, for example of the "Li-ion" type. The voltage given is therefore equal to the sum of the voltages of the two Li-ion batteries. This first solution has two main drawbacks. On the one hand, the purchase of two Li-ion batteries is costlier and the stacking of the two batteries requires appreciably more space, given that the space in a portable device is often a precious resource. On the other hand, it is complicated to manage a battery pack with two batteries because the charge of these two batteries has to be balanced simultaneously.

A second approach, presented with reference to FIG. 1*b*, consists of the use of a voltage step-up converter (DC-DC converter) with only one battery. This approach gives higher voltage with a single battery. However, the voltage step-up converter is a device that takes up space and is costly, and furthermore entails an additional loss of energy because its use leads to a rapid drop in the charge of the battery.

The existing solutions are not at all adapted to the novel types of terminals. Indeed, these terminals are extremely compact devices in which the functions are designed and arranged to reduce the use of space and volume. Thus, it is not possible to envisage integrating two batteries into such terminals. For example, payment terminals are increasingly compact devices which, according to the regulations in force, should be capable of being held in one hand. Similarly, for portable terminals, as in the case of the other terminals, the different components are in direct competition with each other to consume the energy provided by the battery. This is the case for example of the screen (which is tending to increase in size) and systems for wireless reception and transmission of data. Now, current solutions cannot respond to these problems.

There is therefore a need to provide a solution that responds to the problems of speed, cost, compactness and long service life that are raised by novel types of terminals.

3. SUMMARY

The present disclosure does not raise at least some of the problems of the prior art. Indeed, the described technique relates to a method for managing a printing of data by a thermal printer, comprising a thermal print head, said thermal head comprising a plurality of points, each point having an effective resistance $r_d$, said one thermal printer being powered by a power source.

Such a method comprises the following actions:

- measuring a voltage U given by said power source of said thermal printer;
- measuring an internal resistance $r_u$ of said power source, and computing a duration t for heating a number n of points as a function of said voltage U of said power source, said internal resistance $r_u$ of the power source, at least one effective resistance $r_d$ of at least one point corresponding to a dot to be printed for the printing of said data and as a function of at least one value of parasitic resistance $r_p$ of at least one element of said thermal printer.

Thus, the heating time can be computed with fine precision as a function especially of parameters that are liable to evolve in time.

According to one particular characteristic, said thermal printer has low resistance and said power source is a detachable battery of a device within which said thermal printer is installed.

According to one particular characteristic, said duration is computed according to the following formula:

$$t = \frac{W \times r_d}{U_d^2 \times n} = \frac{(n \times r_u + (r_d + r_p))^2}{n \times r_d \times U^2} \times W$$

wherein:

n is the number of printing points of the print head;

W represents the energy needed to heat n points of the print head;

$r_u$ represents the internal resistance of the power source;

$r_d$ represents the resistance of a printing point of the print head $r_p$ represents the parasitic resistance of a printing point of the print head;

U represents the voltage given by the power source.

According to one particular embodiment, the points of the thermal head are distributed among a predetermined number of modules.

According to one particular characteristic, each of said modules of points has a common parasitic resistance $r_c$, said computation step additionally taking account of a common resistance $r_c$ of at least one module to which said points belong.

According to one particular characteristic, said values of effective resistance $r_d$ of said at least one point of said print head are recorded within a data structure.

According to another aspect, the proposed technique also relates to a thermal printer powered by a power source comprising a thermal print head, said thermal head comprising a plurality of points, each point having an effective resistance $r_d$, the printer 4 being characterized in that it comprises:

a module for measuring a voltage U given by said power source, a module for measuring an internal resistance $r_u$ of said power source, and a module for computing a duration t to heat a number n of points as a function of said voltage U of said power source and said internal resistance $r_u$ of the power source, at least one said effective resistance $r_d$ of at least one point to be printed for the printing of said data as a function of at least one value of parasitic resistance $r_p$ of at least one element of said thermal printer.

According to another aspect, the proposed technique also relates to an electronic device. Such a device comprises a thermal printer as described here above and means for implementing said method for managing printing.

According to one particular characteristic, such a device is a payment terminal provided with a battery.

According to a preferred implementation, the different steps of the methods according to the proposed technique are implemented by one or more software programs or computer programs comprising software instructions that are to be executed by a data processor of a relay module according to the proposed technique, these programs being designed to control the execution of different steps of the methods.

The invention is therefore also aimed at providing a program capable of being executed by a computer or by a data processor, this program comprising instructions to command the execution of the steps of a method as mentioned here above.

This program can use any programming language whatsoever and can be in the form of source code, object code or intermediate code between source code and object code such as in a partially compiled form or in any other desirable form whatsoever.

The proposed technique is also aimed at providing an information medium readable by a data processor, and comprising instructions of a program as mentioned here above.

The information medium can be any entity or communications terminal whatsoever capable of storing the program. For example, the medium can comprise a storage means such as a ROM, for example, a CD ROM or microelectronic circuit ROM or again a magnetic recording means, for example a floppy disk or a hard disk drive.

Furthermore, the information medium can be a transmissible medium such as an electrical or optical signal that can be conveyed via an electrical or optical cable, by radio or by other means. The program according to the proposed technique can especially be uploaded to an Internet type network.

As an alternative, the information carrier can be an integrated circuit into which the program is incorporated, the circuit being adapted to executing or to being used in the execution of the method in question.

According to one embodiment, the proposed technique is implemented by means of software and/or hardware components. In this respect, the term "module" can correspond in this document equally well to a software component as to a hardware component or to a set of hardware and software components.

A software component corresponds to one or more computer programs, one or more sub-programs of a program or more generally to any element of a program or a piece of software capable of implementing a function or a set of functions according to what is described here below for the module concerned. Such a software component is executed by a data processor of a physical entity (terminal, server, gateway, router etc) and is capable of accessing the hardware resources of this physical entity (memories, recording media, communications buses, input/output electronic boards, user interfaces etc.).

In the same way, a hardware component corresponds to any element of a hardware assembly capable of implementing a function or a set of functions according to what is described here below for the component concerned. It can be a programmable hardware component or a component with an integrated processor for the execution of software, for example, an integrated circuit, smart card, a memory card, an electronic board for the execution of firmware etc.

Each component of the system described here above can of course implement its own software modules.

The different embodiments mentioned here above can be combined with one another to implement the proposed technique.

4. FIGURES

Other features and advantages of the invention shall appear more clearly from the following description of an embodiment of the disclosure given by way of simple illustratory and non-exhaustive example and from the appended drawings, of which:

FIGS. 1*a* and 1*b*, already described, illustrate two solutions of the prior art that can be used to provide high voltage to power a high-resistance printer;

FIGS. 2*a* and 2*b* illustrate two simplified circuit diagrams for the heating of a thermal print head;

5. DESCRIPTION

5.1. General Principle

Figure 1A:
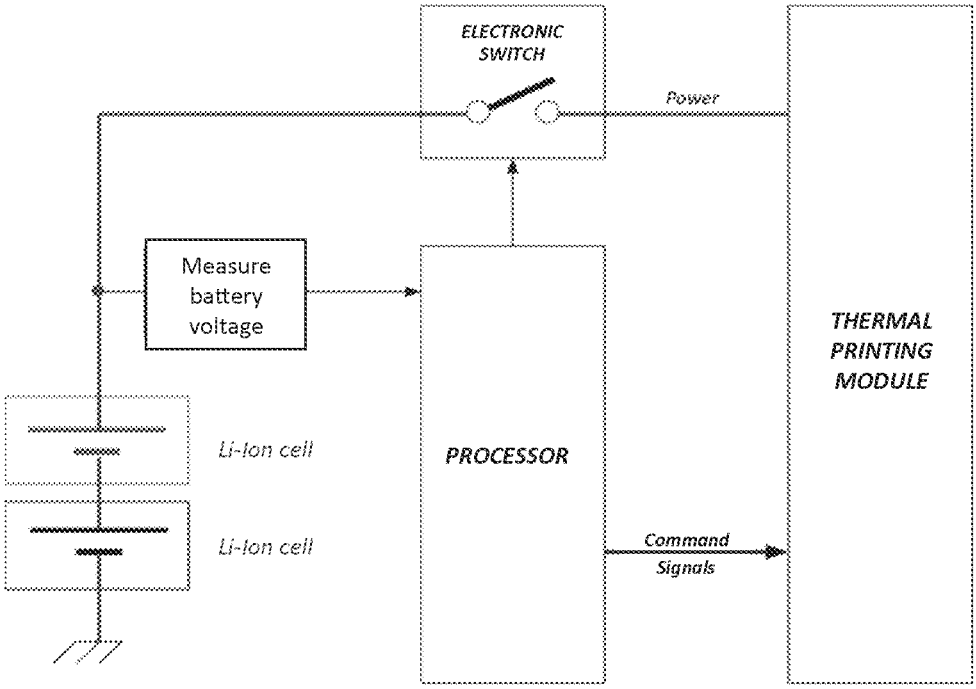

The object of the present technique is to have functional and hardware means that enable the management of available energy to carry out a printing operation as efficiently as possible. This requires especially the use of a method for managing a thermal printer that takes account of the quantity of energy available at source (i.e. in the battery) and takes account of a set of factors of resistance of the electrical circuit: the method described here below therefore makes it possible to take account of these parameters to give the printer (and the printing modules or head) the quantity of energy necessary to print the characters. The energy transmitted to the print heads corresponds therefore solely to the quantity required, thus preventing the waste of energy that can be encountered in existing models. Since the object of the method is to compute the time needed for heating as precisely as possible, the method of management described here below can be applied equally well to low-resistance printers (described here below) and to classic resistance or high-resistance printers.

Besides, this method of management is accompanied by a method of calibration, during which the resistance values of the different components that enter into the implementation of the impression are evaluated. This evaluation makes it possible to ensure that there are reference values available for computations of the quantity of energy transmitted to the different elements of the printer when it is operating. This method of calibration thus enables the intelligent consumption of energy during printing.

The efficient management of energy also requires, at least in one embodiment, the implementation of a specific printer called a low-resistance printer. This printer has the particular feature of working with a single power source, of relatively low voltage. The architecture of implementing such a printer is also described here below.

5.2. Method for Managing a Thermal Printer

It is an object of the present technique to provide constant printing quality at a determined speed while avoiding waste of energy and to do so in a context of limited quantity of energy available. The inventors have identified the fact that the problems of printing quality and waste of energy are caused by overheating or underheating of the points of the thermal print head, resulting from inaccurate computation of the heating duration.

To resolve these problems, the invention proposes a method for managing a thermal printer 4 powered by a power source 45 such as a battery or several batteries comprising a thermal print head 44, said thermal print head comprising a plurality of points, each point having effective resistance $r_d$. The method comprises:

- a step 31 for measuring a voltage (U) given by said power source,
- a step 32 for measuring an internal resistance ($r_u$) of said power source, and
- a step 33 for computing a duration (t) to heat a number (n) of points as a function of said voltage (U) of said power source and said internal resistance ($r_u$) of the power source, at least one effective resistance $r_d$ of at least one point corresponding to a dot to be printed for the printing of said data as a function of at least one parasitic resistance $r_p$ of at least one element of said thermal printer.

Here below and here above, the resistance values are denoted with the lower-case letter r, indexed with a reference in order to distinguish between the resistance values ($r_u$, $r_p$, $r_d$, etc.).

Indeed, the inventors have identified the fact that the voltage and the internal resistance of a power source, such as a battery, are often variable in time. Thus, computing the heating duration takes account of current voltage and resistance values of the power source. The heating duration is thus more precise and avoids the overheating or underheating of the points of the thermal print head.

Figure 1B:
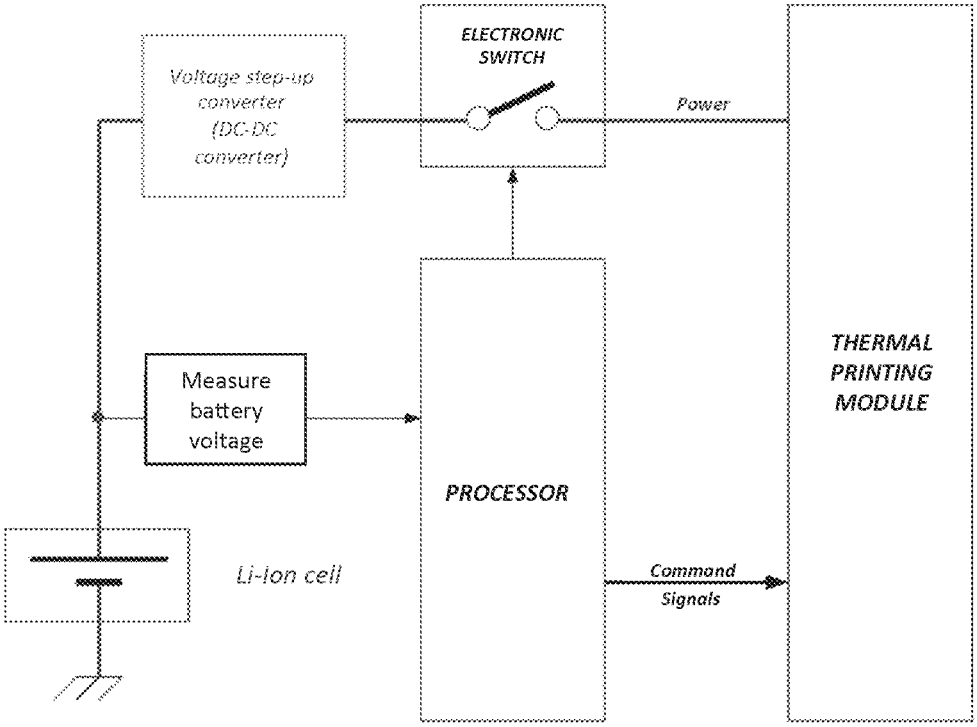

It is another object of the invention to provide a thermal printer that requires less space, is less costly and reduces manufacturing complexity. As illustrated in FIGS. 1*a* and 1*b*, the prior-art printers are powered either by a pack of batteries or by a battery with a voltage step-up converter making it possible to provide high voltage to maintain performance in terms of lines printed per second. However, the systems manufactured according to these two solutions are bulky, costly and complicated.

To resolve the prior-art problems referred to here below, the inventors propose a low-resistance thermal printer powered by a single battery such as a Li-ion battery while at the same time maintaining the performance of the printer.

The voltage of the single battery is of the order of 4 volts. When the voltage U is halved, the duration needed for heating the points will be increased fourfold. This does not ensure the performance of the printer.

To resolve this problem, the inventors propose the use of a low-resistance thermal print head. A printer having a low-resistance thermal print head is also called a low-resistance printer. Indeed, reducing the resistance of the points of the thermal head $r_d$, reduces the duration of heating t. In the present invention, a low resistance corresponds to a value of resistance of a heating element ranging from 50 to 90 ohms ($50\Omega<r_d<90\Omega$). On the contrary, in existing printers, the value of resistance of a heating element ranges from 180 to 220 ohms ($180\Omega<r_d<220\Omega$).

However, the printing quality of the printer according to this solution is highly variable. The inventors have thus observed that the problem of overheating and underheating of the points of the thermal head is as severe as (or even severer than) that raised by printers of the prior art. The inventors have seen that the problem lies in the fact that the heating duration is computed according to the prior-art method (without taking account of variations in voltage, internal resistance of the battery and parasitic resistance of the points of the terminal head). Indeed, when the resistance of the thermal print head is low ($r_d$/n is smaller), this resistance becomes closer to the internal resistance $r_u$ of the battery and the parasite resistances $r_p$ of the points. The influence of the parasite resistances on the computation of the heating duration becomes greater. The method of management described earlier is especially valuable in improving the printing quality of the low-resistance printer powered by a single battery. Another embodiment therefore also proposes a low-resistance thermal printer powered by a power source which is a single battery such as a Li-ion battery.

Thus, this method ensures printing performance and quality while saving on the volume of the components and reducing the cost and complexity of manufacture.

Figure 2A:
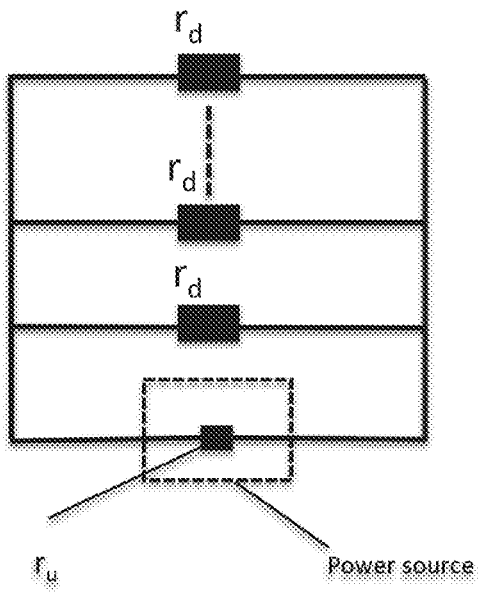

FIG. 2*a* is a simplified circuit diagram of the thermal printer during the heating of the thermal print head. The voltage on n points of the thermal head can be obtained by the following formula:

$$U_d = \frac{\frac{r_d}{n}}{r_u + \frac{r_d}{n}} \times U = \frac{r_d}{r_u \times n + r_d} \times U \tag{3}$$

The energy consumed to heat the n points of the thermal head complies with the formula below:

$$W = P \times t = \frac{U_d^2}{\frac{r_d}{n}} \times t = \frac{n}{r_d} \times U_d^2 \times t \tag{4}$$

Thus, according to the formulae (3) and (4), the duration needed t to heat a number n of points to attain a predetermined temperature can be obtained by the following formula:

$$t = \frac{r_d}{n \times U_d^2} \times W = \frac{(r_u \times n + r_d)^2}{n \times r_d \times U^2} \times W \tag{5}$$

Figure 2B:
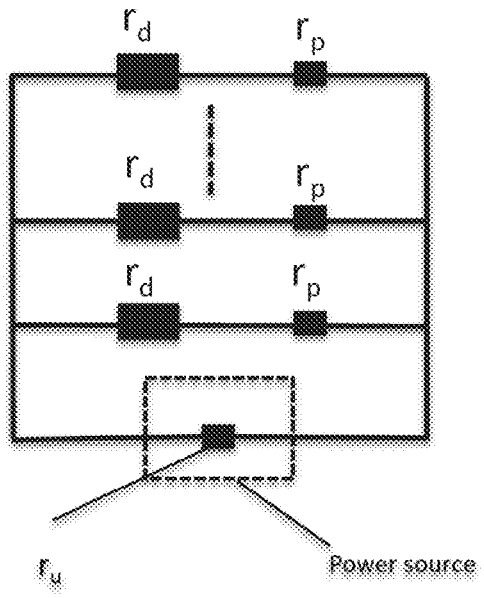
Figure 3:
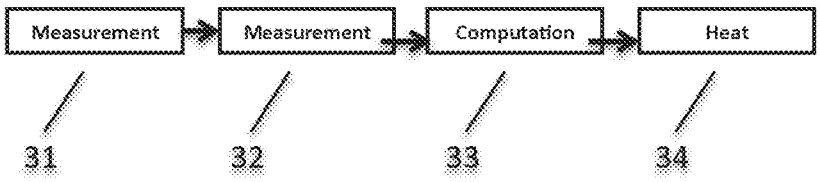
FIG. 3 illustrates the steps of the method for managing a thermal printer according to one embodiment.

The formula for computing the heating duration t, takes account especially of the internal resistance $r_u$ of the power supply source. The inventors have also identified parasitic resistances in the thermal print head as illustrated in FIG. 2*b*. Indeed, each point of the thermal print head has a parasitic resistance $r_p$. This parasitic resistance, although it is minor, is not negligible since the resistance of the points of the print head is itself low.

Thus, according to a specific embodiment of the invention, the step for computing the heating duration of a number n of points also takes account of the parasitic resistance values of the points.

In the circuit diagram of FIG. 2*b*, the voltage at the points of the thermal head can be obtained by the following formula:

$$U_d = \frac{\frac{(r_d + r_p)}{n}}{r_u + \frac{(r_d + r_p)}{n}} \times U \times \frac{r_d}{r_d + r_p} = \frac{r_d}{r_u \times n + (r_d + r_p)} \times U \tag{6}$$

The energy consumed to heat n points of the thermal head complies with the following formula:

$$W = P \times t = \frac{U_d^2}{r_d} \times n \times t \tag{7}$$

Thus, according to the formulae (6) and (7), the duration t needed to heat a number n of points to attain a predetermined temperature can be obtained by the following formula:

$$t = \frac{W \times r_d}{U_d^2 \times n} = \frac{(n \times r_u + (r_d + r_p))^2}{n \times r_d \times U^2} \times W \tag{8}$$

Figure 5:
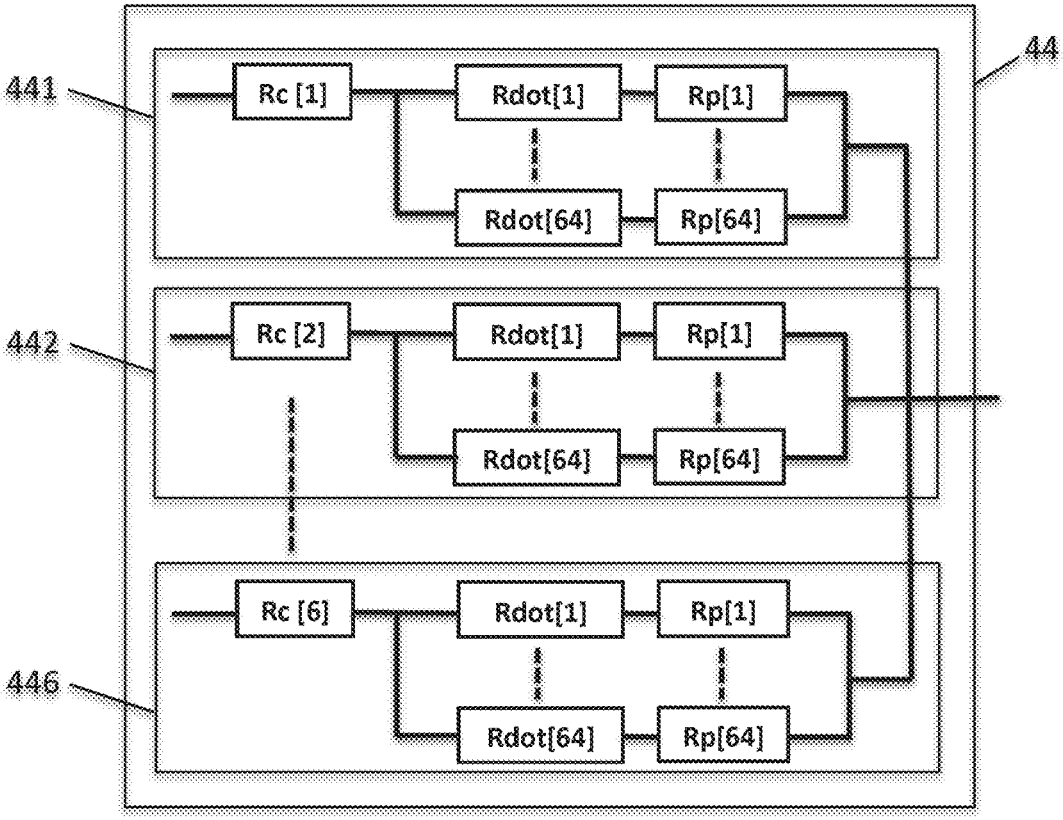
FIG. 5 illustrates the structure of the points of the thermal print head according to one embodiment.

The number of points included in the thermal print head is often very great. According to one specific embodiment, the points can be distributed among several modules. As illustrated in FIG. 5, the 384 points of the thermal print head 44 are distributed among six modules (441, 442, . . . , 446) of points. Each module comprises 64 points. The overall resistance of a module depends on the resistance values of the 64 points $r_{dot}[1]$ to $r_{dot}[64]$, parasitic resistance values $r_p[1]$ to $r_p[64]$ corresponding respectively to the 64 points and a common resistance $r_c$ of the module. The heating step 34 can be carried out separated on each module.

The duration t needed to heat a number n (n≥64) of points to attain a predetermined temperature can be obtained by the following formula:

$$t = \frac{W \times r_d}{U_d^2 \times n} = \frac{(n \times (r_u + R_c) + (r_d + r_p))^2}{n \times r_d \times U^2} \times W \tag{9}$$

Hence, for a same power source (for example a battery), the number of points to be heated in a heating step is necessarily smaller than the number of points of a module (unless it is sought to print a full character, which is rarely the case). Thus, for a same initial state of a battery, if it is necessary to heat from one point to 64 points of the same "module", then the heating time must take account of the losses that increase in the parasitic resistances in order to maintain the energy per point at a sufficiently constant level so that, on the one hand, there is no deterioration on the contrast (if we do not take this into account, then the printing will be paler when more points are printed simultaneously), and on the other hand not to unnecessarily waste energy (the heating could be chosen for the worst case) and performance in terms of speed (and autonomy).

According to one specific embodiment of the invention, the method comprises a step of calibration to evaluate the parasitic resistance of the points and the common resistances of the modules of the points. This calibration step is described here below. This calibration step is used to measure the real values of resistance and therefore to be more efficient in calculating the time during which the energy is used to heat the printing points. Depending on the embodiments and on operational conditions (i.e. modules, printing equipment used especially), this calibration can be done only once, when initializing or booting the electronic device within which the printer is positioned) or else several times, for example once a day when starting up the device, or even more often. The values of the resistances ($r_p$, $r_c$, $r_d$, etc.) are available within a data structure, which can be accessible through the device implementing the management method. Such a data structure is present for example in the form of a flat file or an XML file.

According to a preferred implementation, the different steps of the methods according to the invention are implemented and/or driven by one or more software programs or computer programs comprising software instructions to be executed by a data processor of a relay module according to the invention and designed to control the execution of the different steps of the method or methods of management. The times that are computed on the basis of the values of resistance of the different elements are then used to control the heating of the resistances of the print heads. Depending on the systems and the embodiments, this heating command can be called a "strobe effect" command.

The present technique therefore also relates to a program capable of being executed by a computer or by a data processor, this program comprising instructions to command the execution of the steps of a method as mentioned here above.

5.3. Thermal Printer

Figure 4:
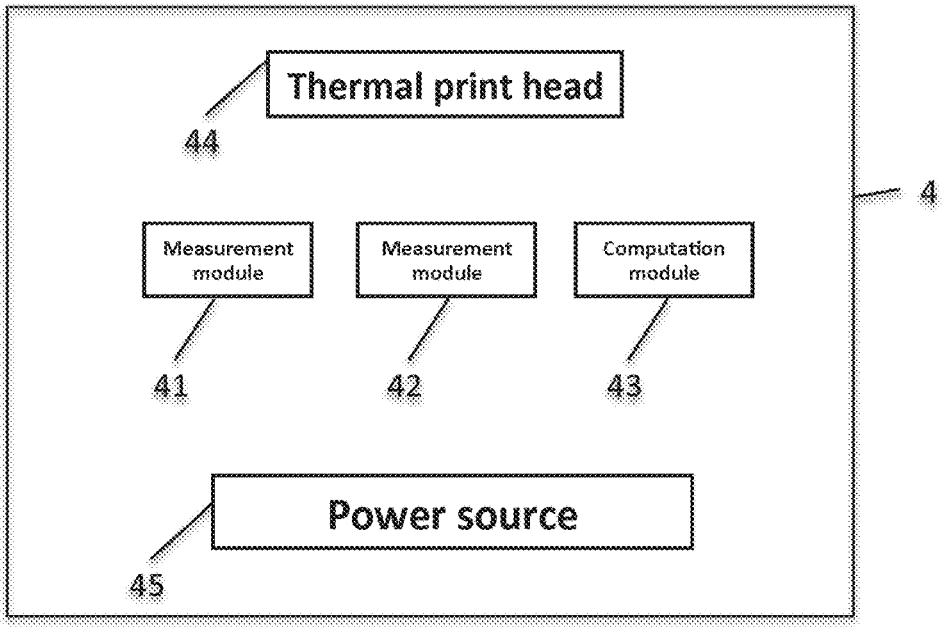
FIG. 4 illustrates the components of a thermal printer according to one embodiment.

The proposed technique also relates to a printer 4 as illustrated in FIG. 4 comprising corresponding means to implement the method of management described here above.

More specifically, the invention proposes a thermal printer 4 powered by a power source 45 such as a battery comprising a thermal print head 44, said thermal print head 44 comprising a plurality of points, each point having an effective resistance $r_d$. The printer 4 is characterized in that it comprises:

- a module 41 for measuring a voltage U provided by said power source,
- a module 42 for measuring an internal resistance $r_u$ of said power source, and
- a module 43 for computing a duration t for heating a number n of points as a function of said voltage U of said power source and said internal resistance $r_u$ of the power source, at least one said effective resistance $r_d$, at least one point to be printed for the printing of said data and as a function of at least one value of parasitic resistance $r_p$ of at least one element of said thermal printer.

The technique also relates to any electronic device comprising a thermal printer as described here above.

According to one specific embodiment, the thermal printer and the electronic device share the same power source. The measuring and computation modules can be integrated into the electronic device which includes a processor, a memory and computer programs to carry out the method of management of a thermal printer.

More specifically, the invention proposes an electronic device powered by a power source such as one or more batteries comprising a thermal printer comprising a thermal print head, said thermal head comprising a plurality of points, each point having an effective resistance ($r_d$), the electronic device comprising:

- a module for measuring a voltage (U) provided by said power source;
- a module for measuring an internal resistance ($r_u$) of said power source; and
- a module for computing a duration (t) to heat a number (n) of points as a function of said voltage (U) of said power source and said internal resistance ($r_u$) of the power source, at least one said effective resistance ($r_d$) of least one point to be printed for the printing of said data and as a function of at least one value of parasitic resistance ($r_p$) of at least one element of said thermal printer.

Figure 6:
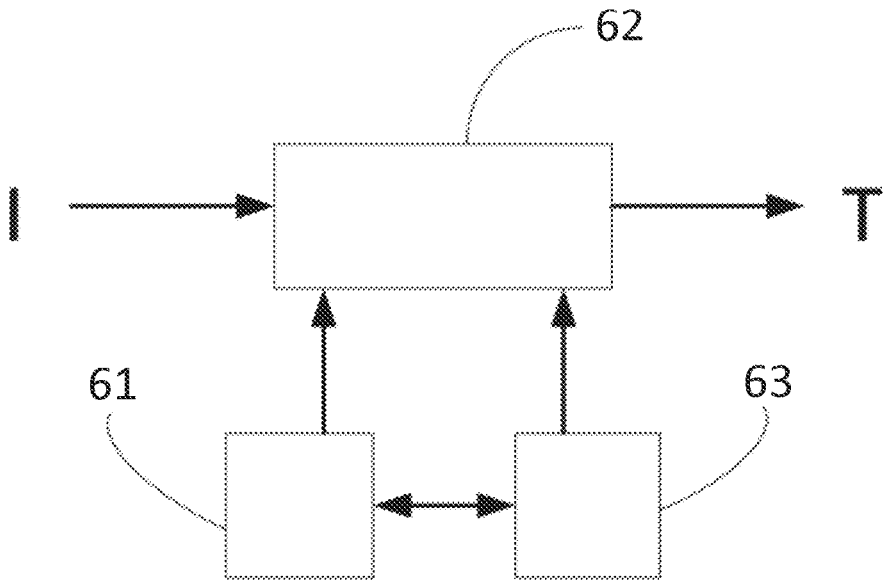
FIG. 6 illustrates a module of a processor for driving the execution of the method of management.

According to one specific embodiment, the electronic device is a payment terminal which, as illustrated in FIG. 6, includes a memory 61 constituted by a buffer memory, a processing unit 62, equipped for example with a microprocessor and driven by the computer program 63 implementing steps necessary for the application of the method of management of a thermal printer.

At initialization, the code instructions of the computer program 63 are for example loaded into a memory and then executed by the processor of the processing unit 62. The microprocessor of the processing unit 62 drives the measuring module 61 and 62 to obtain the voltage and the internal resistance of the power source, and compute the heating duration according to the instructions of the computer program 63. By way of an indication, in one specific embodiment, the battery resistance is equal to 30 mΩ<$r_i$<120 mΩ. The voltage of the battery is equal to 2.7V<$V_{bat}$<4.3V. The resistance of a printing point (dot) is equal to 50Ω<$r_d$<90Ω. The parasitic resistances are equal to: $r_c$=145 mΩ and $r_p$=12Ω

5.4. Calibration Step

As indicated here above, to be able to implement the above described method of driving, it is worthwhile to have a preliminary calibration of the printer. It is possible to make this calibration in several different ways. However, the proposed method described herein has several advantages, including one advantage in terms of calibration time. In the present embodiment, the printer to be calibrated has six modules, each module comprising 64 points. This method of calibration can of course be implemented with a different number of modules. A module is used to carry out the printing of a character.

To make the measurements, the measurement of the voltage of the battery and that of the current consumed in the battery are accessed simultaneously. Any measurement of current is a measurement of a difference of current between the "no-load" state (no consumption related to the printer) and the "load" state (specific consumption related to the printer). Similarly, a difference of voltage is measured between the "no-load" voltage and the "load" voltage.

The calibration of the printer comprises three major phases. The first phase consists in carrying out cold and hot measurements for each point. The second phase consists in measuring the parasitic resistance for each module of points (64 points per module). The third phase consists in measuring the resistance common to the entire print head.

a) Phase 1: Cold and Hot Measurement of Each Point

For each of these 384 points, a cold measurement and a hot measurement is made. A measurement is obtained of a "path" containing all the resistance values in series (overall common resistance, common resistance of the module, resistance of the driving transistor and resistance of the point) for a point. The measurement is for example made as follows:

for the points from 1 to 64:

for the modules from 1 to 6:

- measure the voltage and the current under no load (no point is driven);
- measure voltage and current just at the instant when the point is put under voltage (cold measurement) at the beginning of the strobe effect;
- measure voltage and current at the end of several microseconds (hot measurement) at the end of the strobe effect.

wait for a predetermined time period (until the heating of the point (dot) is dissipated, so that there is no longer any thermal influence on the adjacent point which will be tested thereafter): this period depends on the initial parameters of the print head.

It may be recalled, that strobe corresponds to the command that activates the heating of the resistances. This command is implemented to heat the print head. Depending on the embodiments, this command can be activated for a given period of time, which is computed by the processor in this calibration phase.

The following heat sequence of points is obtained:

| |
|---|
| point#1, point#65, point#129, point#193, point#257, point#321 |
| pause |
| point#2, point#66, point#130, point#194, point#258, point#322 |
| pause |
| ... |
| point#63, point#127, point#191, point#255, point#319, point#383 |
| pause |
| point#64, point#128, point#192, point#256, point#320, point#384 |
| pause |

The value of such a method is that it allows the point N to cool down while testing the points N+64, N+128, N+192, N+256 and N+320 before passing to the point N+1. Thus, the waiting time needed before carrying out the measurement on the point N+1 after the measurement of the point N is limited because this zone has cooled in masked time during the testing of the points N+64, N+128, N+192, N+256 and N+320. It can be noted that it is also possible to use paper (in making it feed forward) to accelerate the cooling of each point and the entire head.

b) Phase 2: Measuring the Parasitic Resistances for Each 64-Point Module

Ideally, if the print head allows it, the 64 points of each module are heated simultaneously, in carrying out a no-load measurement of voltage and current, and then at the beginning of the strobe effect and at the end of the strobe effect. If the head does not allow simultaneous switching of 64 points of each module, the operation will be limited to the maximum that is supported by the module. For this measurement, the problem of adjacency between two measurements is a far greater source of problems than in phase 1. On the one hand, a great deal of energy is added and, on the other hand, since there is only a total of six chips, the distance from a zone that has just been heated is necessarily no more than two chips. An efficient compromise of measurement is the following sequence:

module#1, module#3, module#5, module#2, module#4, module#6 indeed, there is always a difference of two modules between two successive measurements, which reduces the time needed to remove heat from each measurement. Here again, the paper to participate in the discharge of a substantial part of the heat in order to reduce measuring time.

c) Phase 3: Measuring Parasitic Resistors Common to all the Modules

The current is made to pass simultaneously in all the modules, in lighting up the maximum number of points possible on the head, distributed uniformly between each of the six modules.

The method is the same as here above: measurement of voltage and current without load and then at the start and end of the strobe effect.

These three measurement phases give the resistance of the different elements that form the printing circuit of the thermal printer. Once these values of resistance are known, they are used to compute the time needed for heating one or points of one or more modules during the simultaneous printing of the characters. Knowledge of these values then makes it possible to adapt the way in which the printing is done. Thus, for example, it is possible to decide, when the voltage in the battery drops, to carry out sub-optimal printing (i.e. in not completely heating the printing points) for example to carry out a complete printing of a receipt. Such a solution is preferable to the optimal printing of the first lines of a ticket followed by the absence of printing of the following lines (for lack of battery).

These three phases make it possible to obtain resistance values prior to any printing. More particularly, the resistance values obtained are the effective resistance values $r_d$ of each point of each printing module of the print head. Thus, these effective resistance values, which can be called individual effective resistance values, are recorded within a data structure that is accessible to the method of management of printing and that enables the computation of the heating time of each point as a function of the data to be printed.

These three phases also make it possible to obtain the values of parasitic resistance $r_p$, $r_c$ of the modules and of other elements of the printing circuit. These resistance values are also recorded within a data structure accessible to the methods of management of the printing. Thus, prior to the printing, a computation is made from known values measured beforehand which effectively take account of the real state of the printer and not solely of the theoretical value when the device leaves the factory plant.

The invention claimed is:

1. A method for managing a printing of data by a thermal printer, comprising a thermal print head, said thermal head comprising a plurality of points, each point having an effective resistance $r_d$, said thermal printer being powered by a power source, wherein the method comprises the following actions:

measuring a voltage U given by said power source of said thermal printer;

measuring an internal resistance $r_u$ of said power source, and computing a duration t for heating a number n of points as a function of said voltage U of said power source, said internal resistance $r_u$ of the power source, said effective resistance $r_d$ of at least one point corresponding to a dot to be printed for the printing of said data and as a function of at least one value of parasitic resistance $r_p$ of at least one element of said thermal printer, wherein said duration is computed according to the following formula:

$$t = \frac{W \times r_d}{U_d^2 \times n} = \frac{(n \times r_u + (r_d + r_p))^2}{n \times r_d \times U^2} \times W$$

wherein:

n represents the number of printing points of said thermal print head;

W represents the energy needed to heat n points of said thermal print head;

$r_p$ represents the parasitic resistance of a printing point of said thermal print head.

2. The method of management according to claim 1, wherein said thermal printer has low resistance and said power source is a detachable battery of a device within which said thermal printer is installed.

3. The method of management according to claim 1, wherein the points of the thermal head are distributed among a predetermined number of modules.

4. The method of management according to claim 3, wherein each of said modules of points has a common parasitic resistance $r_c$, and said act of computing additionally taking account of a common resistance $r_c$ of at least one module to which said points belong.

5. The method of management according to claim 1, wherein said values of effective resistance $r_d$ of said at least one point of said print head are recorded within a data structure.

6. A thermal printer powered by a power source and comprising:

a thermal print head, said thermal head comprising a plurality of points, each point having an effective resistance $r_d$, a processor; and a non-transitory computer-readable medium comprising instructions stored thereon, which when executed by the processor configure the thermal printer to perform acts comprising:

measuring a voltage U given by said power source, measuring an internal resistance $r_u$ of said power source, and computing a duration t to heat a number n of points as a function of said voltage U of said power source and of said internal resistance $r_u$ of the power source, at least one said effective resistance $r_d$ of at least one point to be printed for the printing of said data as a function of at least one value of parasitic resistance $r_p$ of at least one element of said thermal printer, wherein computing computes said duration according to the formula below:

$$t = \frac{W \times r_d}{U_d^2 \times n} = \frac{(n \times r_u + (r_d + r_p))^2}{n \times r_d \times U^2} \times W$$

wherein:

n represents the number of printing points of said thermal print head;

W represents the energy needed to heat n points of said thermal print head;

$r_p$ represents the parasitic resistance of a printing point of said thermal print head.

7. An electronic device comprising the thermal printer according to claim 6.

8. The electronic device according to claim 7, wherein the electronic device takes the form of a payment terminal.

9. A non-transitory computer-readable medium comprising instructions stored thereon and comprising program code instructions for execution of a method for managing printing of data by a thermal printer, when the instructions are executed on a computer of the thermal printer, which comprises a thermal print head, said thermal print head comprising a plurality of points, each point having an effective resistance $r_d$, said thermal printer being powered by a power source, wherein the method comprises the following actions:

measuring a voltage U given by said power source of said thermal printer;

measuring an internal resistance $r_u$ of said power source, and computing a duration t for heating a number n of points as a function of said voltage U of said power source, said internal resistance $r_u$ of the power source, said effective resistance $r_d$ of at least one point corresponding to a dot to be printed for the printing of said data and as a function of at least one value of parasitic resistance $r_p$ of at least one element of said thermal printer, wherein said duration is computed according to the following formula:

$$t = \frac{W \times r_d}{U_d^2 \times n} = \frac{(n \times r_u + (r_d + r_p))^2}{n \times r_d \times U^2} \times W$$

wherein:

n represents the number of printing points of said thermal print head;

W represents the energy needed to heat n points of said thermal print head;

$r_p$ represents the parasitic resistance of a printing point of said thermal print head.

* * * * *